US006250530B1

(12) United States Patent
LaCount et al.

(10) Patent No.: US 6,250,530 B1
(45) Date of Patent: Jun. 26, 2001

(54) MULTIPLE ROLL TOWEL DISPENSER

(75) Inventors: Kenneth H. LaCount, Pulaski; Diane L. Stephan, Green Bay; Todd G. Welsch, Green Bay; Alan J. Pierquet, Green Bay; Alan P. Paal, Green Bay, all of WI (US)

(73) Assignee: Alwin Manufacturing Co., Green Bay, WI (US)

( * ) Notice: Subject to any disclaimer, the term of this patent is extended or adjusted under 35 U.S.C. 154(b) by 0 days.

(21) Appl. No.: 09/110,766

(22) Filed: Jul. 6, 1998

Related U.S. Application Data

(62) Division of application No. 08/705,326, filed on Aug. 29, 1996, now Pat. No. 6,032,898.

(51) Int. Cl.[7] ..... B26F 3/02

(52) U.S. Cl. ..... 225/10; 225/43; 225/34; 83/436.15; 83/650

(58) Field of Search ..... 242/564.4, 564.2; 226/127, 128, 129; 225/10–12, 14–16, 34, 39, 43, 46, 42, 47; 83/649, 650, 949, 436.15

(56) References Cited

U.S. PATENT DOCUMENTS

| | | | | |
|---|---|---|---|---|
| 2,334,757 | * | 11/1943 | Ensminger | 242/55.5 |
| 2,919,842 | | 1/1960 | Batlas | 225/12 |
| 2,930,664 | | 3/1960 | Liebisch | 312/39 |
| 2,974,839 | | 3/1961 | Batlas et al. | 225/12 |
| 3,007,650 | | 11/1961 | Burton | 242/55.3 |
| 3,126,234 | | 3/1964 | Batlas et al. | 312/39 |
| 3,288,387 | | 11/1966 | Craven, Jr. | 242/55.53 |
| 3,297,269 | * | 1/1967 | McGrew | 242/55.53 |
| 3,301,617 | * | 1/1967 | Goodwin et al. | 312/39 |
| 3,628,743 | | 12/1971 | Bastian | 242/55.3 |
| 3,730,409 | * | 5/1973 | Ratti | 225/14 |
| 3,731,318 | * | 5/1973 | Dickey | 346/145 |
| 3,843,218 | | 10/1974 | Krueger et al. | 312/38 |
| 3,917,191 | | 11/1975 | Graham, Jr. | 242/55.3 |
| 4,066,220 | * | 1/1978 | Beck et al. | 242/55 |
| 4,067,509 | | 1/1978 | Graham, Jr. | 242/55.3 |
| 4,165,138 | | 8/1979 | Hedge et al. | 312/39 |
| 4,192,442 | | 3/1980 | Bastian et al. | 226/127 |
| 4,203,562 | | 5/1980 | DeLuca et al. | 242/55.3 |
| 4,236,679 | | 12/1980 | Jespersen | 242/55.53 |
| 4,317,547 | | 3/1982 | Graham, Jr. | 242/55.3 |
| 4,358,169 | | 11/1982 | Filipowicz | 312/39 |
| 4,378,912 | | 4/1983 | Perrin et al. | 242/55.3 |
| 4,396,163 | | 8/1983 | Graham, Jr. | 242/55.3 |
| 4,403,748 | | 9/1983 | Cornell | 242/55.53 |
| 4,406,421 | | 9/1983 | Schultz et al. | 242/55.53 |
| 4,417,495 | * | 11/1983 | Gordon et al. | 83/175 |
| 4,611,768 | | 9/1986 | Voss et al. | 242/55.3 |
| 4,756,485 | | 7/1988 | Bastian et al. | 242/55.3 |
| 4,846,412 | | 7/1989 | Morand | 242/55.3 |
| 4,856,724 | | 8/1989 | Jespersen | 242/55.3 |
| 5,042,351 | * | 8/1991 | Rosenthal | 83/649 |
| 5,294,192 | | 3/1994 | Omdoll et al. | 312/34.22 |
| 5,400,982 | | 3/1995 | Collins | 242/560 |
| 5,526,973 | | 6/1996 | Boone et al. | 225/34 |

* cited by examiner

*Primary Examiner*—Kenneth E. Peterson
(74) *Attorney, Agent, or Firm*—Emrich & Dithmar

(57) ABSTRACT

A dispenser for dispensing a web from a roll of paper includes a housing and a cover connected thereto to provide access to the housing interior. The dispenser has mechanism for supporting a paper roll and a drive roller and tension roller operatively associated therewith which urges paper from the paper roll into contact with the drive roller for dispensing a length of paper from the paper roll. Actuator mechanism operates the drive roller and extends across substantially the entire housing at the bottom thereof. A roller frame assembly is mounted within the housing and carries the tension roller and a transfer roller. The transfer roller releasably holds the free end of a first paper roll while paper from the second roll is dispensed upon actuation of the actuator to rotate the drive roller. Because the paper from a second paper roll is positioned between the drive roller and the transfer roller, rotation of the transfer roller during rotation of the drive roller is prevented until the second paper roll is exhausted.

3 Claims, 5 Drawing Sheets

FIG. 11
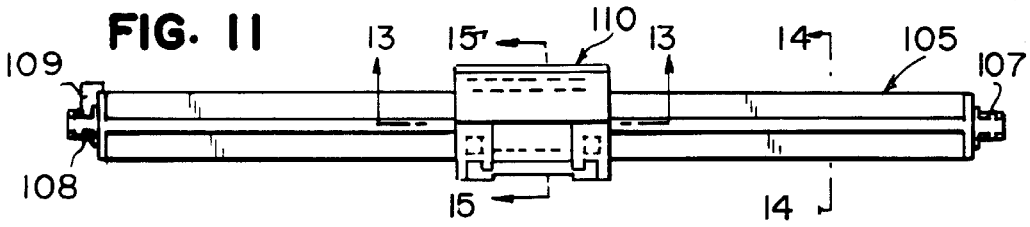
FIG. 12
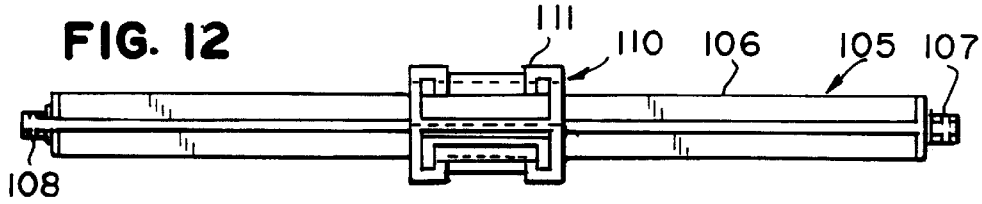
FIG. 14
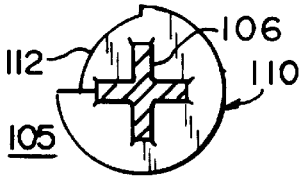
FIG. 15
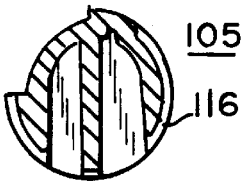
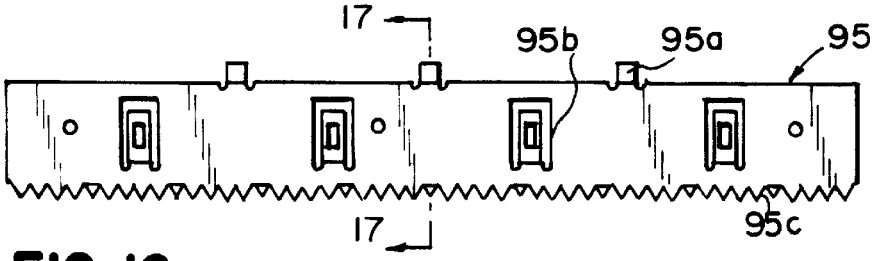
FIG. 16
FIG. 13
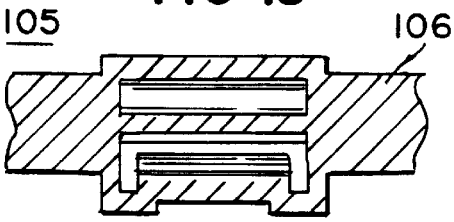
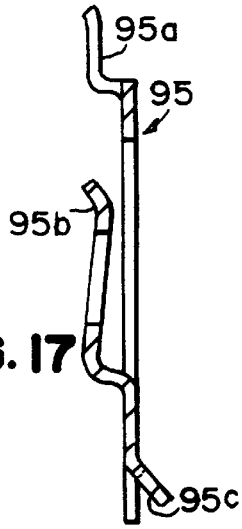
FIG. 17

MULTIPLE ROLL TOWEL DISPENSER

This is a divisional of application Ser. No. 08/705,326 filed Aug. 29, 1996, now U.S. Pat. No. 6,032,898.

BACKGROUND OF THE INVENTION

This invention relates to a paper roll towel dispenser of the type which is capable of dispensing paper toweling and automatically dispensing paper from a reserve roll of toweling after a stub roll has been exhausted.

The invention provides a paper roll towel dispensing cabinet which includes a roll supporting cradle or bottom in which a stub roll is housed and a transfer mechanism which carries the free end of a reserve roll of paper toweling. After the stub roll is exhausted, the transfer mechanism operates automatically to dispense paper towel from the reserve roll of toweling. Such transfer assemblies in and of themselves are not new as disclosed in the Collins U.S. Pat. No. 5,400,982. However, most transfer mechanisms result in the transfer of toweling from both the reserve roll and the stub roll, whereas the present invention is designed such that the transfer mechanism only operates when the stub roll is exhausted.

The invention also relates to a method of dispensing toweling which is novel and conforms with the current ADA legislation for disabled persons. Additionally, the invention includes interior mechanism which provides for easy maintenance in the field, a desirable feature due to the fact that towel cabinets of the type set forth herein are commonly used in restaurant washrooms, gas station restrooms and other places where maintenance is sporadic and the level of skill of the maintenance people is not high.

SUMMARY OF THE INVENTION

Accordingly, an object of the invention is to provide a paper towel dispenser in which an actuator means is pivotally mounted on the cabinet housing outwardly of the housing and extends substantially across the entire housing at the bottom thereof.

Another object of the invention is to provide a towel dispenser with an actuator of the type set forth in which the pressure needed to dispense toweling is less than about 2 to 3 psi which is well below the ADA limit of 5 psi.

Another object of the invention is to provide a roller frame assembly pivotally mounted within the cabinet housing movable between the use position wherein a tension roller carried by the roller frame assembly is in contact with the paper web and urges same against a drive roller for dispensing the paper web from the cabinet and a maintenance position in which the roller frame assembly falls away from the drive roller permitting easy access to the interior of the towel cabinet for loading fresh rolls of toweling into the cabinet.

Yet another object of the invention is to provide a transfer roller for releasable holding the free end of a reserve roll of toweling which is transferred when the stub roll of toweling is exhausted.

The invention consists of certain novel features and a combination of parts hereinafter fully described, illustrated in the accompanying drawings, and particularly pointed out in the appended claims, it being understood that various changes in the details may be make without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 11 is a front elevational view of the transfer roller;

FIG. 12 is a view like FIG. 11 rotated 90°;

FIG. 13 is an enlarged view partially in section of the transfer roller illustrated in FIG. 11 as seen along line 13-13 thereof;

FIG. 14 is a view in section of the transfer toller illustrated in FIG. 11 as seen along line 14-14 thereof;

FIG. 15 is a view in section of the transfer roller illustrated in FIG. 11 as seen along line 15-15 thereof;

FIG. 16 is a front elevational view of a tear bar; and

FIG. 17 is a view of the tear bar assembly illustrated in FIG. 16 as seen along lines 17-17 thereof.

DESCRIPTION OF THE PREFERRED EMBODIMENT

Figure 2:
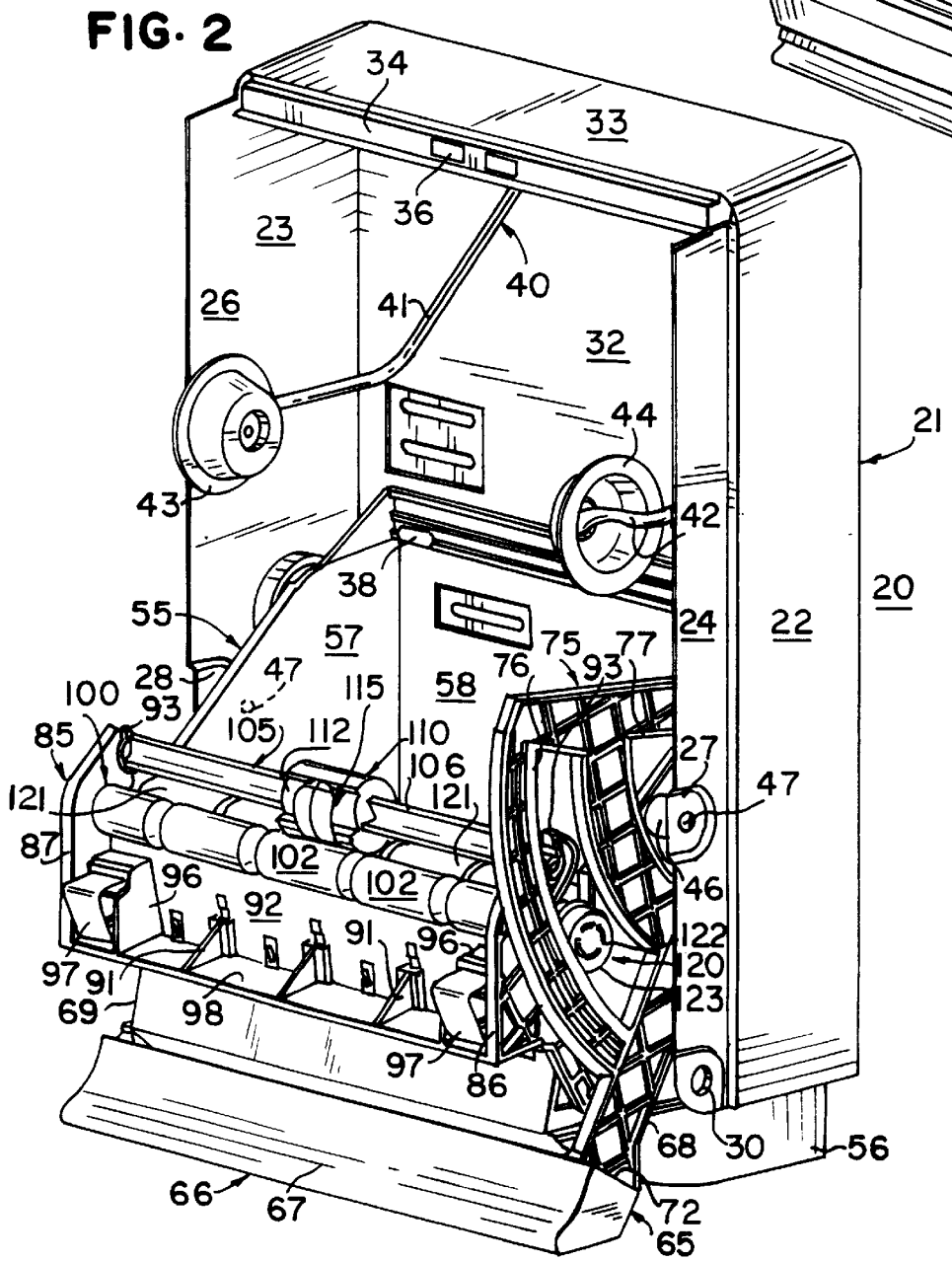
FIG. 2 is an enlarged perspective view of the cabinet illustrated in FIG. 1 with the cover removed and the roller frame assembly in the non-maintenance or operating position thereof.

Referring to the drawings, there is disclosed a dispenser 20 which includes a housing 21 comprised of opposed and parallel side walls 22 and 23, each of the side walls 2 and 23 respectively have an offset outwardly extending flange 24 and 26. The outwardly extending flange 24 from the side wall 22 has a stamped portion 27 and similarly the outwardly extending offset flange 26 of the wall 23 has a stamped portion 28. An aperture 30, for a purpose hereinafter set forth, is positioned at the bottom of the flange 24 and a corresponding aperture (not shown) is in registry with the aperture 30 in the flange 26. The housing 21 further includes a rear wall 32 which extends downwardly and interconnects the side walls 22 and 23 and the back terminates at the bottom edge of the side walls and a top wall 33 which interconnects the tow side walls 22 and 23 and the back wall 32. Forwardly extending from the top wall 33 is a stair step ledge 34 which includes a pair of lock apertures 36 for a purpose hereinafter to be explained. A pair of clips 38, only one of which is seen in FIG. 2, extend from the rear wall 32 for a purpose hereinafter set forth. A roll holder assembly 40 is mounted to the rear wall 32 of the housing 21 and has a pair of resilient arms 41 and 42 extending from a right portion of the paper roll holder assembly 40, the right portion not being shown. The paper roll holder assembly 40 is standard in the art and includes a pair of hubs 43 and 44, respectively, extending inwardly from the arms 41 and 42.

A sleeve 46 extends inwardly from the stamped portion 27 of the flange 24 and is held in place by a screw 47, the sleeve 46 being for a purpose hereinafter set forth while the screws 47 serve to maintain a chassis 55 within the housing 21, as will be described.

Figure 5:
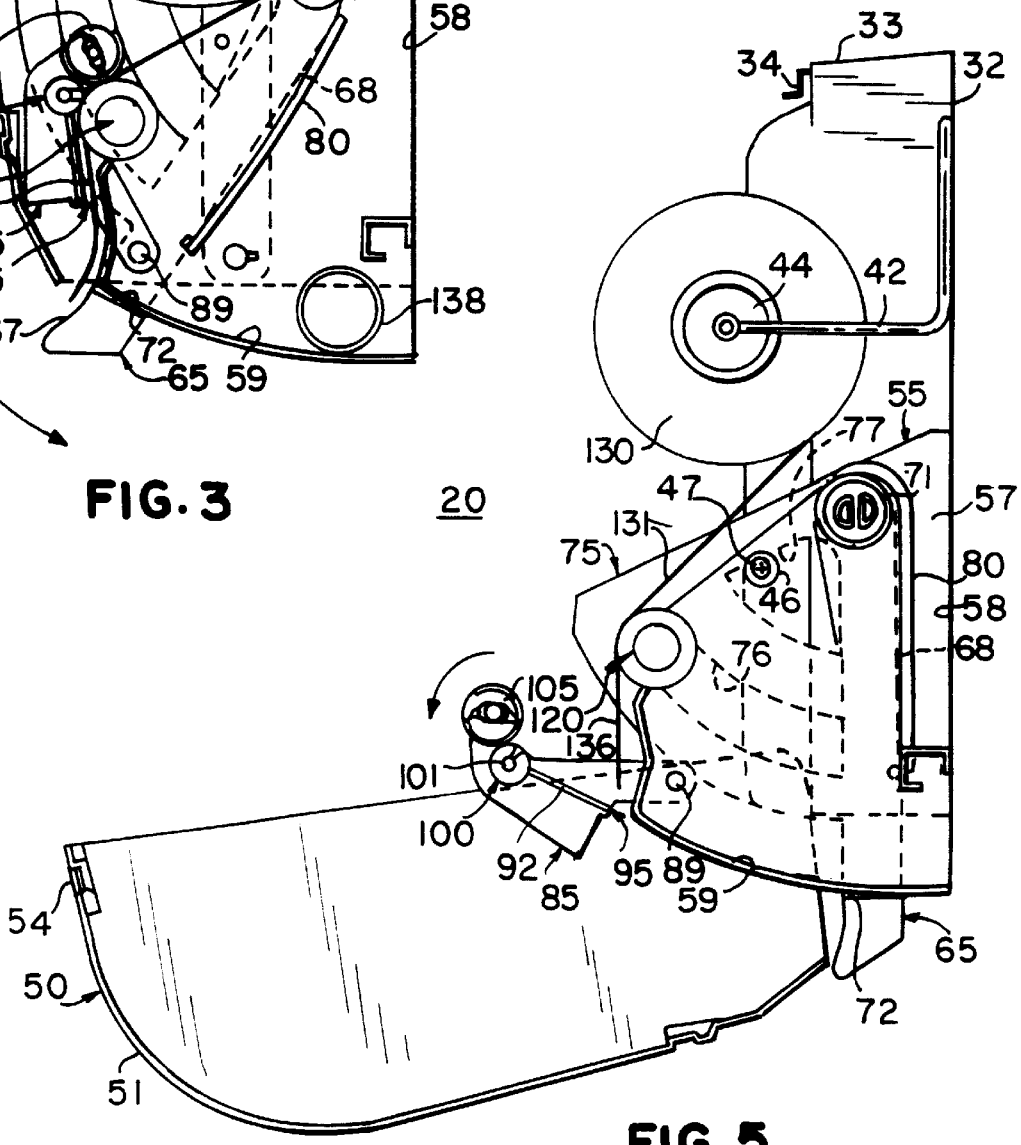
FIG. 5 is a view like FIG. 3 with the cabinet cover in the open position showing the mechanism being positioned for replacement of the toweling.

A cover 50 is pivotally mounted to the housing 21 at the spaced apertures 30, the cover including a front panel 51 integral with a top panel 52 and two side panels 53. Locking mechanism 54 as seen in FIG. 5 is provided in the top panel 52 and cooperates with the two lock apertures 36 to secure the cover 50 to the housing 21, in a well recognized fashion.

As previously stated, the chassis 55 is mounted within the housing 21 on the clips 38 extending from the rear wall 32 and maintained in place by a pair of screws 47 extending from the stamped portions 27 and 28 in the sides of the housing 21. The chassis 55 includes spaced parallel side walls 56 and 57 interconnected by a rear wall 58 and a curved arcuate bottom wall 59 which forms a well for a stub roll as will be explained. The bottom of the chassis extends below the housing 21.

Figure 3:
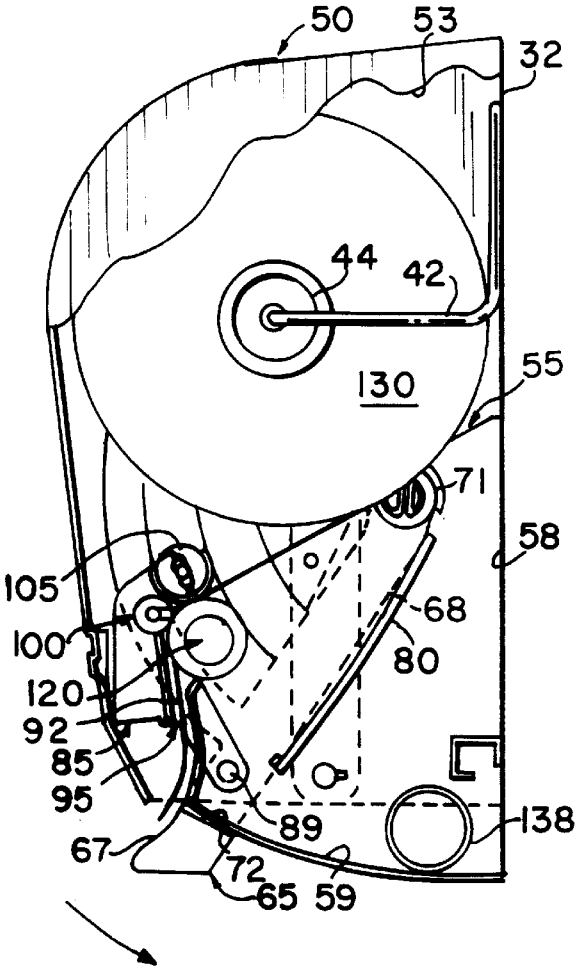
FIG. 3 is a side elevational view with the cover broken away showing a stub roll exhausted and a reserve roll of toweling in position to be dispensed by the mechanism.
Figure 4:
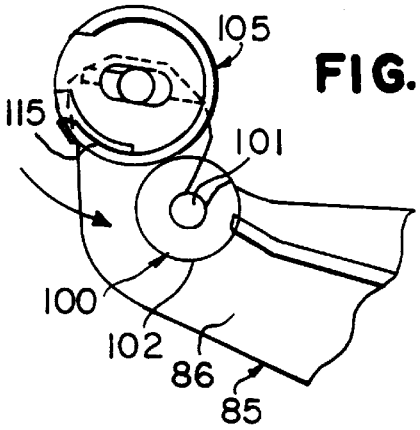
FIG. 4 is an enlarged view of the transfer and tension roller mechanism when the roller frame assembly is in its maintenance position in the absence of toweling connected to the transfer mechanism.

An actuator assembly mechanism 65 includes a push bar 66 extending across the bottom of the housing 21 which includes a concave surface 67 against which the user pushes, the push bar 66 being connected to an arm 68 and an arm 69 at opposite ends of the push bar 66. The arm 68 is pivotally connected to the chassis side wall 56 and the arm 69 is pivotally connected to the chassis side wall 57. As seen in FIGS. 3 and 5, the arm 68 has a bearing 71 which mounts the push bar 66 and the actuator assembly mechanism 65 to the chassis 55, the other bearing for the arm 69 not being illustrated. The push bar 66 has an inner edge 72 which is positioned adjacent the bottom wall 59 of the chassis 55 a distance preferably less than fingers width to prevent injury to a user described operation of the dispenser 20, as hereinafter will be described, as well as preventing vandalism of the dispenser 20.

The actuator assembly mechanism 65 has one arm 68 thereof which includes an arcuate segment 75 which carries a quadrant gear 76 with the gear teeth facing inwardly but not being illustrated for purposes of clarity. The gear teeth on the quadrant gear 76 are for a purpose hereinafter set forth. A second open portion in segment 75 has a stop wall 77 which contacts the sleeve 46 extending inwardly of the flange 44, for a purpose hereinafter set forth. Finally, a torsion spring 80 cooperates with the arm 69 in a manner which is well known, to provide resistance to the actuation of the actuator assembly mechanism 65 and to bias the assembly mechanism 65 into its rest position illustrated in FIG. 2.

A roller frame assembly 85 includes spaced apart side wall members 86 and 87, interconnected by a bottom plate 88, the roller frame assembly 85 having arm extensions through which extend pivot mounting aperatures 89 (see FIG. 5) pivotally mounting the roller frame assembly to the chassis 55. Reinforcement members 91 extend from the bottom plate 88 to an upstanding wall 92, as best seen in FIG. 2, and bearings 93 are located at the top of the side walls 86 and 87 for a purpose hereinafter set forth.

A tear bar 95 as best seen in FIGS. 16 and 17 is either mounted to or integral with the bottom of the roller frame assembly 85. The tear bar 95 may be provided with tabs **95*a* and clips 95*b* for attachment to the bottom of the roller frame assembly 85 if the tear bar 95 is not molded as part of the roller frame assembly 85. A serrated edge 95*c* is at the bottom of the tear bar 95** for a purpose to be explained.

Finally, spring receptacles 96 at both sides of the roller frame assembly 85 from a box-like device between the bottom plate 88 and adjacent side walls 86 or 87 to house two leaf springs 97 which extend forwardly of the roller frame assembly 85 and cooperate with the cover 50 and particularly the front 51 thereof when the cover is in its closed position, as will be explained.

A tension roller assembly 100 is rotatably mounted on the roller frame assembly 85 and has a pair of bearings, not shown. The tension roller assembly 100 includes a shaft 101, see FIGS. 3–10, and spaced roller segments 102. A transfer roller assembly 105 is mounted interior of the tension roller assembly 100 on bearings 93 of the roller frame assembly 85. The transfer roller assembly 105 includes a shaft cruciform in cross section, see FIGS. 11–15, provided with a journal 107 at one end and a journal 108 at the other end of the shaft, the journal 108 having a stop plate 109 extending upwardly from the journal, for a purpose to be set forth. A transfer mechanism 110 is positioned generally centrally of the shaft 106 and includes a cylindrical portion 11 having an indented or removed portion 112 and a groove or receptacle 116 which receives a snap clip 115, as seen in FIG. 2, which is resilient and cooperates with the portion 112 for a purpose hereinafter set forth.

A drive roller assembly 120 is rotatably mounted on the chassis 55 and includes a plurality of longitudinally spaced apart drive roller segments 121 on a shaft connected at one end to a drive gear 122 at one end of the shaft. The drive gear 122 is more completely described in U.S. Pat. No. 3,843,218 issued to Krueger et al. Oct. 22, 1995, the disclosure of which is herein incorporated by reference. The drive gear 122 includes drive gear teeth 123 which mesh with the quadrant gear teeth 76. The drive gear 122 further includes a one-way clutch assembly, all as previously described in the above-mentioned '218 patent.

A paper roll 130 may be mounted on the paper roll holder assembly 40 and more particularly between the two spaced apart hubs 43 and 44 thereof. The arms 41 and 42 are resilient to allow the arms to be spread to accommodate a new paper roll 130. A flight of paper 131 from the roll 130 extends from the roll and as will be explained, passes over the drive roller 120 and is held thereagainst by the action of the tension roller assembly 100, as is common in the art. The free end 132 of the paper roll 130, when installed may be inserted under the clip 115 of the transfer mechanism 110 as will be described. When the paper roll 130 has been partially dispensed, it may be moved downwardly into the well formed by the bottom wall 59 of the chassis 55 whereupon it becomes a stub roll 135, the core 138 of which is shown in FIG. 3 in the well provided by the bottom 59 of chassis 55. A flight of paper 136 from the stub roll 135 passes over the drive roller assembly 120 as particularly illustrated in FIGS. 6 and 8.

Figure 1:
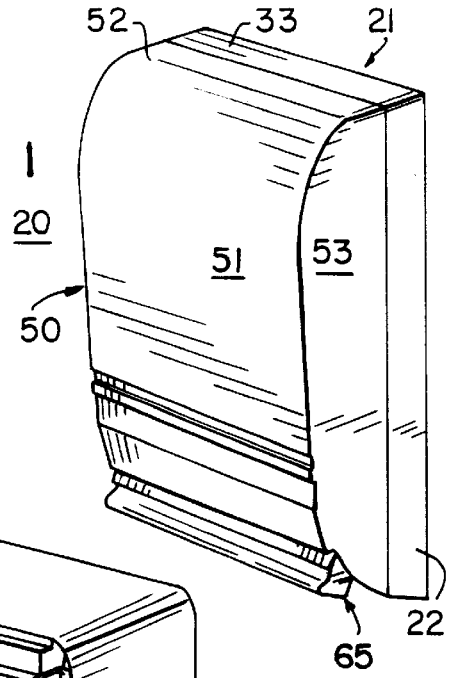
FIG. 1 is a perspective view of a paper roll towel dispenser embodying the invention with the cover closed.

Operation of the dispenser 20 is hereinafter set forth. Referring now to FIGS. 2, 3, 4 and 5 of the drawings, it will be seen that when the cover 50 of the dispenser 20 is moved away from the locked position thereof shown in FIG. 1 to the position shown in FIG. 5, the roller frame assembly 85 rotates outwardly about the pivot shafts in apertures 89 such that the tension roller 100 and the transfer roller 105 carried on the roller frame assembly 85 are away from the drive roller mechanism or assembly 120 and the interior of the housing 21 is accessible. A reserve roll of toweling 130 may be inserted onto the paper roll holder assembly 40 by spreading the arms 41 and 42 apart so as to locate the hubs 43 and 44 into the core of a paper roll 130. The flight 131 of which can be positioned easily over the drive roller assembly 120 as illustrated in FIG. 5, it being appreciated that FIG. 5 shown a paper roll 130 which is partially dispensed while FIG. 3 shows a paper roll that is reserve. The flight 131 of the paper roll 130 passes over the drive roller assembly 120 and thereafter the cover 50 can be moved from the open position shown in FIG. 5 to the closed position shown in FIG. 3. Movement of the cover 50 to the closed position of FIG. 3 causes the leaf springs 97 mounted on the roller frame assembly 85 to come in contact with the inside of the cover front panel 51 and resiliently to urge the tension assembly 100 into contact with the flight 131 from the paper roll 130 thereby to ensure frictional contact between the paper flight 131 and the drive roller assembly 120 and more particularly the drive roller segments 121 thereof.

As can be seen in FIG. 3, the actuator assembly mechanism 65 is in the home or rest position in FIG. 3 whereas when the housing 21 is open for maintenance, the actuator assembly mechanism 65 is moved from the rest or home position illustrated in FIG. 3 to the dispensing position illustrated in FIG. 5. In the position illustrated in FIG. 5, it will be noted that the segment stop wall 77 is in contact with the sleeve 46 to prevent further rotation of the actuator assembly mechanism 65 around the pivots or mounting 71 to the chassis 55. The sleeve 49 in cooperation with the stop wall 77 also limits the amount of toweling dispensed with each actuation of the push bar 66.

Figure 8:
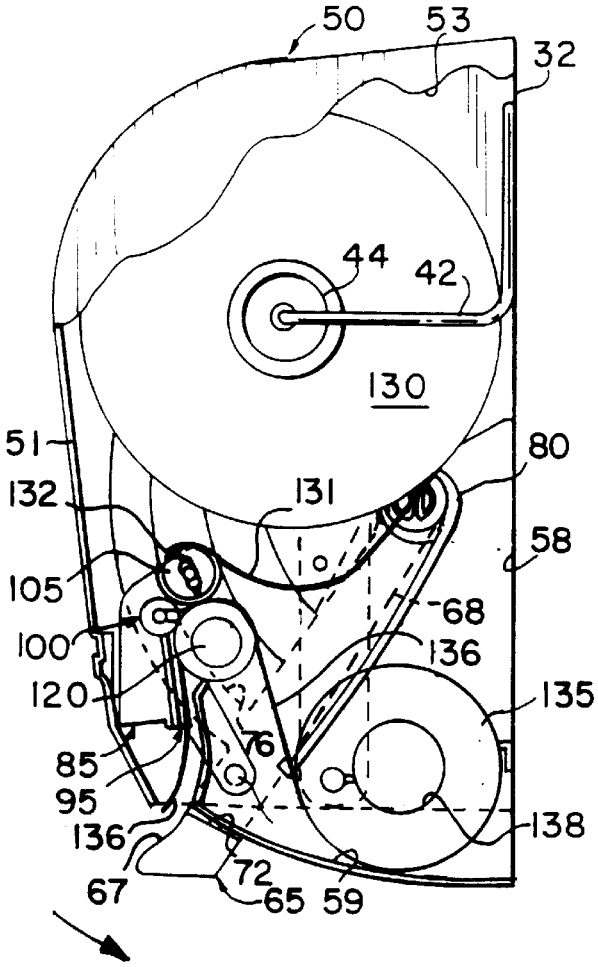
FIG. 8 is a view like FIG. 3 with both the stub roll and the reserve roll configured for operation.
Figure 7:
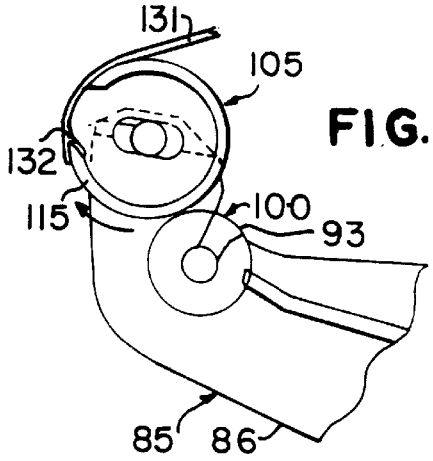
FIG. 7 is a view like FIG. 4 with the free end of a fresh roll being attached to the transfer mechanism.
Figure 6:
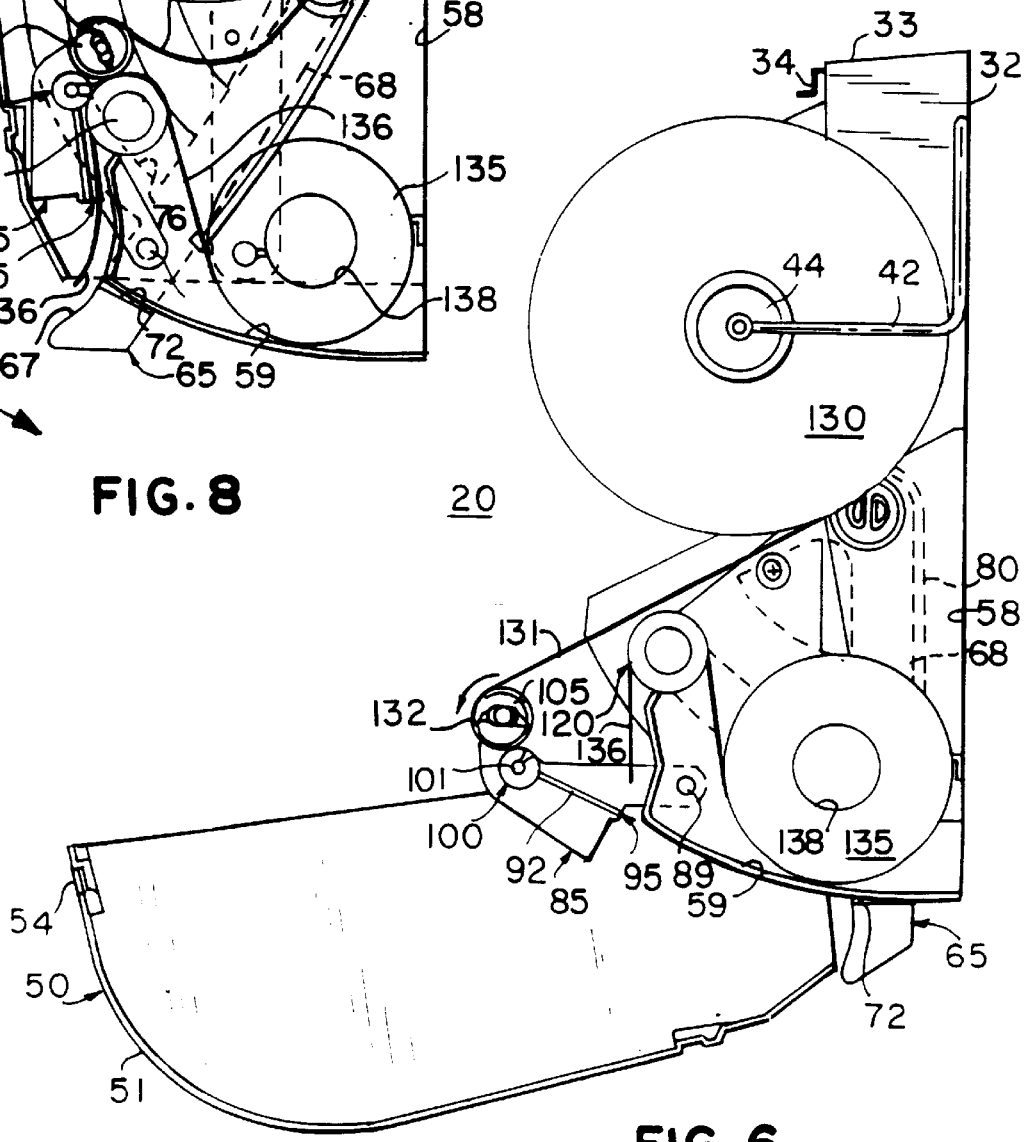
FIG. 6 is a view like FIG. 5 with a stub roll being positioned in the bottom of the cabinet and a reserve roll being added with the free end thereof attached to the transfer mechanism.
Figure 9:
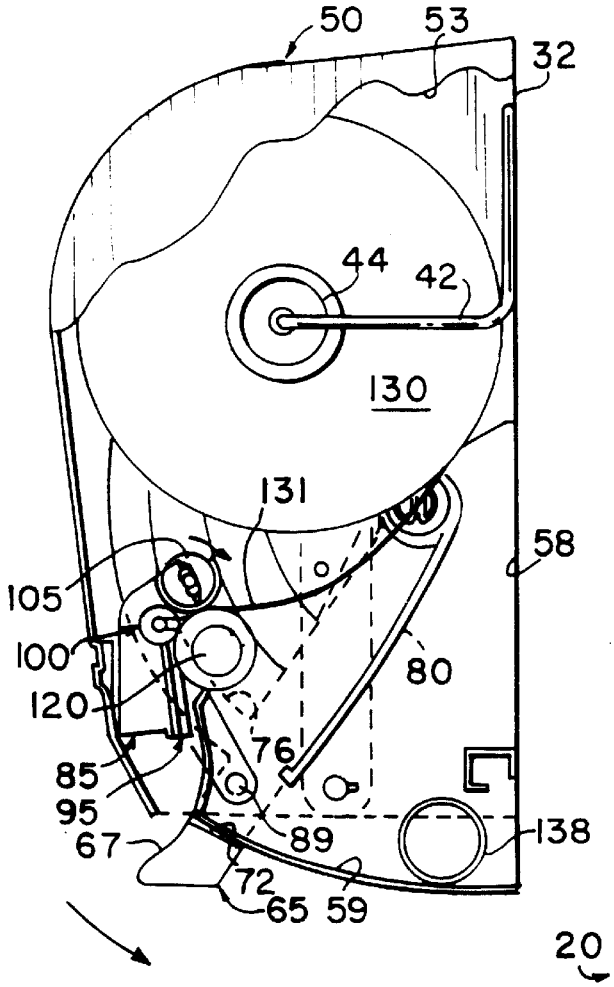
FIG. 9 is a view like FIG. 3 showing the operation of the transfer mechanism upon exhaustion of the stub roll.
Figure 10:
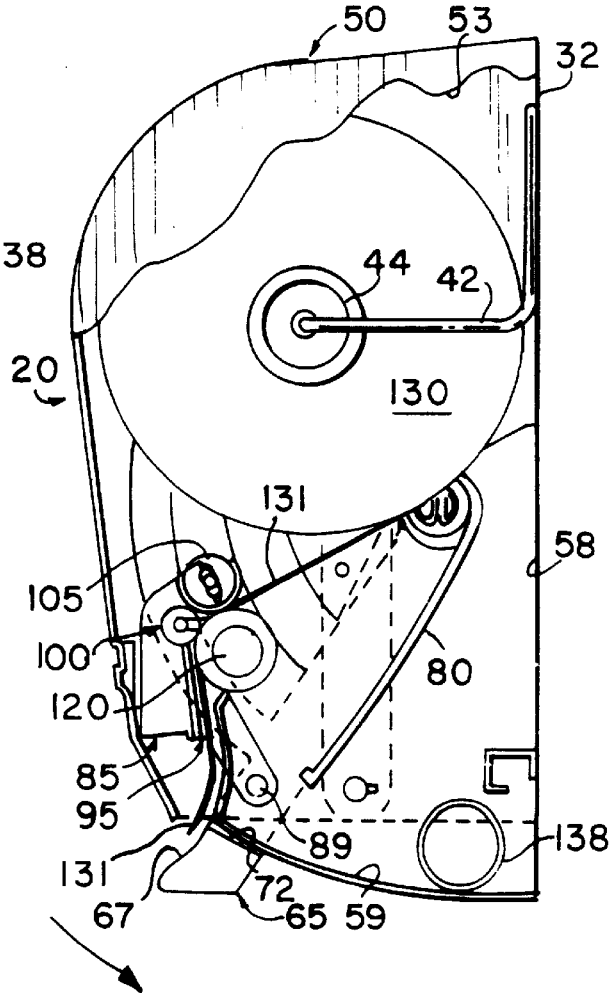
FIG. 10 is a view like FIG. 9 further along in the dispensing cycle.

After a certain amount of the roll 130 has been dispensed, the towel dispenser 20 is again opened to the position shown in FIG. 5. This time, a portion of the roll 130 remains and a reserve roll of toweling can now be moved into position. As illustrated in FIGS. 6–8, the previous roll of toweling partially dispensed (but preferably having a diameter of about 4 inches or less) is now moved into the position shown in FIGS. 6 and 8 and is denoted by the reference numeral 135 as a stub roll which rests on the bottom 59 of the chassis 55. The flight 136 extending from the stub roll 135 which is mounted on a core 138 as seen in FIGS. 3, 9 and 10, still passes over the drive roller assembly 120. After the stub roll 135 is moved to the position shown in FIGS. 6 and 8, a fresh roll 130 of toweling can be inserted onto the paper roll holder assembly 40 as previously described. The flight 131 having a free end 132 is then threaded into the transfer roll assembly 105. More specifically, the free end 132 of the flight 131 is retained under the clip 115 which urges the toweling against the indented portion 112 of the transfer mechanism 110 after the free end 132 of the reserve roll 130 is inserted into the clip 115, the flight 131 from the reserve toll 130 passes over the flight 136 from the stub roll 135 and is therefore out of contact with the drive roller assembly 120 and more particularly out of contact with the drive roller segments 121. The drive roller segments 121 are preferably made from a tacky material such as rubber or other frictional materials such as sand paper or the like in order to drive the flight of toweling in contact therewith. Because of the weight of the roller frame assembly 85 with both tension roller assembly 100 and transfer roller assembly 105 mounted thereon, the roller frame assembly 85 moves to its maintenance position illustrated in FIG. 6 when the cover 50 is in the open position as illustrated in FIGS. 5 and 6.

When the cover 50 is moved to its closed position as illustrated in FIG. 8, the leaf springs 97 bear against the inside of the front 51 of the cover 50 and urge the roller frame assembly 85 into the position illustrated in FIG. 8 wherein the tension roller assembly 100 and more particularly the roller segments 102 thereof are urged against the flight 136 of the stub roller 135 which passes over the drive roller assembly 120 to ensure frictional contact between the drive roller segments 121 and the flight 136. As will be noted from FIGS. 6 and 8, the transfer roller assembly 105 is out of contact with the drive roller assembly 120 due to the flight 136 from the stub roll 135 which passes therebetween. In this condition, actuation of the actuator assembly 65 to dispense paper toweling 136 from the dispenser 20 does not cause rotation of the transfer roller assembly 105.

As before noted, the torsion spring biases the actuator assembly mechanism 65 into the position shown in FIGS. 3 and 8. Movement of the push bar 66 causes rotation of the drive roller assembly 120. More particularly, movement of the actuator assembly mechanism 65 to the right as shown in FIGS. 3 and 8 causes the quadrant gear 76 and the teeth thereof to engage the teeth 123 on the drive gear 122 to cause the drive gear 122 and thereby the drive roller segments 121 to rotate in a counter clockwise direction. The one way clutch in the mechanism 122 disengages after the actuator assembly mechanism 65 reaches the end of its stroke whereupon the sleeve 46 comes in contact with the stop surface 77 of the arcuate segment 75. When the torsion spring causes the push bar 66 to move to the left in the direction opposite of the arrows in FIGS. 3 and 8, the one way clutch assembly in the drive gear 122 disengages whereby the drive rollers 121 do not rotate in an opposite direction. Repeated actuation of the push bar 66 causes the stub roll 135 to be dispensed, in general a web of approximately 5–12 inches of toweling is dispensed with each complete actuation of the actuator assembly mechanism 65 and toweling is torn from the dispenser 20 by engagement of the flight of toweling with the tear bar 95 and particularly the serrated edge 95*c*. In some instances, the paper is glued to the roll and in these instances the roll tends to interfere with the transfer roll assembly 105. To prevent this core stops may be added to prevent contact of the roll with the transfer roll assembly 105.

When the paper roll 130 gets to be approximately four inches in diameter, it can be moved from the position shown in FIG. 3 and becomes a stub roll 135 as shown in FIGS. 6 and 8. After a reserve roll 130 is inserted into the dispenser 20 and the free end 132 of the flight 131 is inserted the clip 115 as previously discussed, the configuration illustrated in FIGS. 6 and 8 is obtained. In FIG. 9 the stub roll 135 is exhausted and a free end 132 of the flight 131 is moved into the nip formed between the transfer roller 105 and the drive roller assembly 120, all as illustrated in FIG. 9, because the absence of flight 131 causes the transfer roll assembly 105 to contact the drive rollers 121 causing clockwise rotation of the transfer roller 105. Continued movement of the actuator assembly 65 to the right or in the direction of the arrow in FIG. 9 causes the free end 132 of the flight 131 to move between the transfer roller 105 and the drive roller 120 until the free end 132 meets the nip between the tension roller 100 and the drive roller assembly 120. Further actuation then causes the flight 131 to be dispensed from the housing 121 as previously illustrated. Rotation of the transfer roller 105 is limited by the stop plate 109. Thereafter, toweling is dispensed in response to actuation of the actuator assembly mechanism 65 until the roll 130 is reduced to about four inches in diameter whereafter it can be moved as a stub roll 135 to the position illustrated in FIGS. 6 and 8.

An important feature of the present invention is the relationship between the actuator assembly mechanism 65 and particularly the push bar 66 thereof and the bottom 59 of the chassis 55. The close spatial relationship in the arc of travel of the bar 66 and the shape of the bottom 59 prevent users from inadvertently jamming a finger between the inner edge surface 72 of the push bar 66 and the bottom 59 of the chassis 55. This is an important safety feature and particularly useful for young children.

Another important feature of the present invention is the fact that the push bar 66 extends entirely across the width of the housing 21. This configuration of the push bar 66 permits easy use of the dispenser 20 by both left handed and right handed individually as well as by disabled persons in wheelchairs or younger users who are not tall enough to reach the usual mechanisms which are higher up on the housing 21. The dispenser 20 may be made out of plastic or metal as may be the major constituents of the dispenser. Preferably, the housing is made of a plastic material and molded in one piece. The cover 50 may also be molded of a single piece and pivotally mounted onto the housing 21. The chassis 55 is also preferably molded as a single piece and is easily inserted into the housing 21, even in the field due to the clips 38 and the screws 47. The roller frame assembly 85 is also preferably molded as a single plastic piece and the tear bar 95 may be either integrally molded with the roller frame assembly 85 or may be a metal piece clipped on by use of the tabs 95*a* and the resilient clips 95*b*. The transfer roller assembly 105 can also be integrally molded as a single piece with the clip 115 being snap fit into the receptacle 116 provided in the transfer mechanism cylindrical position 111. As previously stated, the stop plate 109 serves to limit the amount of rotation of the transfer roller assembly 105 so that the transfer roller assembly 105 rotates through approximately 180° of arc.

Because the quadrant gear 76 causes the drive roller to rotate in a counter clockwise direction as viewed in FIG. 9, the transfer roller 105 rotates in a clockwise direction until the free end 132 of the flight 131 is introduced into the nip between the tension roller 100 and the drive roller assembly 120.

A significant aspect and important object of the invention is that the dispenser 20 is designed to transfer the reserve roll 130 only when the stub roll 135 is exhausted. Although it may be that under certain conditions of high static electricity, a premature transfer may take place, the only result of this is that two flights of paper 131 and 136 are dispensed simultaneously, a condition which can be endured and is preferred to the situation where no paper is dispensed. Nevertheless, under the usual and ordinary commercial working situation, the dispenser 20 will operate to transfer paper at a zero condition, that is when the stub roll 135 is exhausted and the transfer roller 105 and most particularly the cylindrical portion 111 thereof comes in contact with the drive roller segments 121 thereby causing rotation of the transfer roller 105 to introduce the free end 132 of the flight 131 into the nip between the drive roller assembly 120 and the tension roller assembly 100. At the present time, the dispenser 20 dispenses about 5-½ inches of towel per stroke, but this can be varied by means well know in the art.

While there has been disclosed what is considered to be the preferred embodiment of the present invention, it is understood that various changes in the details may be made without departing from the spirit, or sacrificing any of the advantages of the present invention.

What is claimed is:

1. In a dispenser for dispensing a web from a roll of paper, said dispenser including a housing and a housing cover connected thereto movable between a closed position and an open position to provide access to the housing interior, said housing defining a dispensing outlet and including means for supporting a paper roll within said housing, a drive roller rotatably mounted inside said housing for dispensing a length of paper from the paper roll, drive means for rotating said drive roller including actuator means operatively connected to said drive means, the improvement comprising a roller frame assembly mounted within said housing carrying a tension roller thereon, said roller frame assembly being movable between a use position wherein said tension roller contacts a paper web from the roll of paper urging the paper web against said drive roller and a maintenance position wherein said housing cover is in its open position and said roller frame assembly is spaced away from said drive roller to provide access to the housing interior and to said means for supporting a paper roll, and said roller frame assembly being movable between said use position and said maintenance position independently of the housing cover, said roller assembly being biased by gravity toward its maintenance position such that when said housing cover is in its open position said tension roller is spaced away from said drive roller permitting easy insertion of a paper web therebetween, and said roller frame assembly carries spring means contacting said housing cover when in it's closed position urging said roller frame and said tension roller toward said driver roller to maintain frictional contact between the paper web and said drive roller, whereby movement of said actuator when said housing cover is in its closed position and said roller frame is in its use position operates said drive means to rotate said drive roller causing paper in contact therewith to be unwound from the paper roll and dispensed through said dispensing outlet.

2. The dispenser of claim 1, wherein said roller frame assembly is pivotally mounted with respect to said housing.

3. The dispenser of claim 1, and further comprising a serrated tear at the bottom of said roller frame assembly for tearing paper dispensed by movement of said actuator.

* * * * *

UNITED STATES PATENT AND TRADEMARK OFFICE

CERTIFICATE OF CORRECTION

PATENT NO. : 6,250,530 B1
DATED : June 26, 2001
INVENTOR(S) : Kenneth H. LaCount et al.

It is certified that error appears in the above-identified patent and that said Letters Patent is hereby corrected as shown below:

Column 8, claim 1,
Line 26, delete "said" and insert -- a --.
Line 27, delete "a" and insert -- said --.
Line 48, delete "operate" and insert -- operating --.

Signed and Sealed this

Fifteenth Day of January, 2002

*Attest:*

*Attesting Officer*

JAMES E. ROGAN
*Director of the United States Patent and Trademark Office*